US009611811B2

(12) United States Patent
Ohashi et al.

(10) Patent No.: US 9,611,811 B2
(45) Date of Patent: Apr. 4, 2017

(54) CONTROL DEVICE FOR COOLING SYSTEM

(75) Inventors: Nobumoto Ohashi, Susono (JP); Taro Aoyama, Susono (JP); Naoya Okamoto, Tokyo (JP); Yoshio Yamashita, Susono (JP); Yuki Haba, Mishima (JP); Hajime Takagawa, Susono (JP); Koki Uno, Susono (JP); Naoki Takeuchi, Susono (JP); Masashi Shinoda, Susono (JP); Teruhiko Miyake, Shizuoka-ken (JP); Koji Nakayama, Ogaki (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 268 days.

(21) Appl. No.: 14/366,041

(22) PCT Filed: Dec. 19, 2011

(86) PCT No.: PCT/JP2011/079381

§ 371 (c)(1),
(2), (4) Date: Sep. 15, 2014

(87) PCT Pub. No.: WO2013/093997

PCT Pub. Date: Jun. 27, 2013

(65) Prior Publication Data

US 2015/0027387 A1 Jan. 29, 2015

(51) Int. Cl.
*F01P 7/00* (2006.01)
*F02M 25/07* (2006.01)
(Continued)

(52) U.S. Cl.
CPC ..... *F02M 25/0738* (2013.01); *F01P 7/14* (2013.01); *F01P 7/165* (2013.01); *F01P 11/16* (2013.01);
(Continued)

(58) Field of Classification Search
CPC .... F01P 7/16; F01P 7/164; F01P 7/165; F01P 2025/32; F01P 2025/62
(Continued)

(56) References Cited

U.S. PATENT DOCUMENTS

2003/0089319 A1* 5/2003 Duvinage ..... B60H 1/02 123/41.02
2007/0028902 A1 2/2007 Nigoro et al.
2007/0173371 A1* 7/2007 Hayashi ..... B60K 6/445 477/3

FOREIGN PATENT DOCUMENTS

CN 1884804 A 12/2006
GB 2472228 2/2011
(Continued)

*Primary Examiner* — Hung Q Nguyen
*Assistant Examiner* — Charles Brauch
(74) *Attorney, Agent, or Firm* — Finnegan, Henderson, Farabow, Garrett & Dunner, LLP

(57) ABSTRACT

The influenced of condensed water on an EGR device is alleviated. A device (100) that controls a cooling system including adjusting means for being able to adjust a circulation amount of coolant in a first flow passage, including an engine cooling flow passage, an EGR cooling flow passage and a radiator flow passage, and a second flow passage, including the engine cooling flow passage, the EGR cooling flow passage and a bypass flow passage and not including the radiator flow passage, includes: measuring means for measuring a temperature of the coolant; limiting means for limiting circulation of the coolant at starting an internal combustion engine; and control means for circulating the coolant preferentially through the second flow passage via control over the adjusting means based on the measured temperature in a period in which circulation of the coolant is limited.

7 Claims, 5 Drawing Sheets

(51) Int. Cl.

| | |
|---|---|
| ***F02D 21/08*** | (2006.01) |
| ***F01P 7/14*** | (2006.01) |
| ***F01P 11/16*** | (2006.01) |
| ***F02D 41/00*** | (2006.01) |
| ***F02M 26/50*** | (2016.01) |
| ***F02M 26/28*** | (2016.01) |
| ***F02M 26/32*** | (2016.01) |
| ***F02M 26/33*** | (2016.01) |
| *F01P 7/16* | (2006.01) |
| *F01P 3/02* | (2006.01) |

(52) U.S. Cl.
CPC ..... *F02D 21/08* (2013.01); *F02D 41/0065* (2013.01); *F02M 26/28* (2016.02); *F02M 26/32* (2016.02); *F02M 26/33* (2016.02); *F02M 26/50* (2016.02); *F01P 7/16* (2013.01); *F01P 2003/027* (2013.01); *F01P 2003/028* (2013.01); *F01P 2025/32* (2013.01); *F02D 2041/007* (2013.01)

(58) Field of Classification Search
USPC ..... 123/41.02
See application file for complete search history.

(56) References Cited

FOREIGN PATENT DOCUMENTS

| | | |
|---|---|---|
| JP | 11-351073 | 12/1999 |
| JP | 2007-40141 | 2/2007 |
| JP | 2007-263034 | 10/2007 |
| JP | 2009/216028 | 9/2009 |
| JP | 2010-163920 | 7/2010 |
| JP | 2010-285894 | 12/2010 |
| JP | 2011-17296 | 1/2011 |
| JP | 2011-47305 | 3/2011 |

* cited by examiner

CONTROL DEVICE FOR COOLING SYSTEM

CROSS-REFERENCE TO RELATED APPLICATIONS

This application is a national phase application of International Application No. PCT/JP2011/079381, filed Dec. 19, 2011, the content of which is incorporated herein by reference.

TECHNICAL FIELD

The invention relates to a technical field of a control device for a cooling system, which controls a cooling system configured to be able to cool cooled objects, including an internal combustion engine and an EGR device, through circulation of coolant.

BACKGROUND ART

As this kind of system, a system that includes a coolant control valve for controlling passage of water to an engine body, a EGR cooler, auxiliaries, and the like, and that limits passage of coolant at cold starting has been suggested (for example, see Patent Document 1). With the above system, because circulation of coolant is stopped at starting, a warm-up of the internal combustion engine can be suitably facilitated.

Patent Document 2 describes a technique for facilitating a warm-up of a cylinder block by supplying coolant, heated at an EGR cooler by exhaust gas, to the cylinder block.

Patent Document 3 describes a technique for preventing an overheat by circulating coolant in an engine or an EGR cooler even when a water pump is stopped.

RELATED ART DOCUMENT

Patent Document

Patent Document 1: Japanese Patent Application Publication No. 2007-263034 (JP 2007-263034 A)
Patent Document 2: Japanese Patent Application Publication No. 2011-047305 (JP 2011-047305 A)
Patent Document 3: Japanese Patent Application Publication No. 2010-285894 (JP 2010-285894 A)

SUMMARY OF THE INVENTION

Problem to be Solved by the Invention

Incidentally, an EGR cooler changes in temperature gently after starting as compared to relatively high-temperature portions among cooled objects, such as a cylinder head close to a combustion chamber and an exhaust manifold and a cylinder block that accommodates a cylinder on the lower side of the cylinder head, and its temperature rise is slow as compared to these high-temperature portions.

Thus, before completion of a warm-up of the internal combustion engine, the temperature of exhaust gas that serves as EGR gas that is guided to near the EGR cooler via an EGR pipe or the temperature of exhaust gas that serves as EGR gas that stagnates near the EGR cooler at that timing easily decrease. This tendency is remarkable, at cold starting. When the temperature of exhaust gas excessively decreases, moisture in exhaust gas condensates, so condensed water is produced.

Here, the EGR pipe that guides EGR gas is mostly generally formed of a metal material because high heat resistance is obtained, and leaving condensed water may promote corrosion degradation of these pipes. That is, in a configuration in which an EGR device is included, temperature management of an EGR cooler is required when an internal combustion engine has not been warmed up yet.

Incidentally, in existing devices including those described in the above various Patent Documents, such a problem has not been conceived of, and control of coolant with consideration given to condensed water that is produced because of a decrease in the temperature of EGR gas is not executed. Thus, to resolve an inconvenience that can be brought to the EGR device by condensed water is practically close to almost impossible.

The invention is contemplated in view of such a problem, and it is an object of the invention to provide a control device for a cooling system, which is able to relieve an influence brought to an EGR device by condensed water.

Means for Solving the Problem

In order to solve the above-described problem, a control device for a cooling system according to the invention, which controls a cooling system in a vehicle including an internal combustion engine, an EGR device including an EGR cooler, and the cooling system that is able to cool cooled objects, including the internal combustion engine and the EGR device, through circulation of coolant, the cooling system including a flow passage portion that is able to pass the coolant and that includes an engine cooling flow passage for cooling the internal combustion engine, an EGR cooling flow passage for cooling the EGR device, a radiator flow passage that passes through the radiator and a bypass flow passage that bypasses the radiator; and adjusting means for being able to adjust a circulation amount of the coolant in a first flow passage including the engine cooling flow passage, the EGR cooling flow passage and the radiator flow passage and a second flow passage including the engine cooling flow passage, the EGR cooling flow passage and the bypass flow passage and not including the radiator flow passage, includes: measuring means for measuring a temperature of the coolant; limiting means for limiting circulation of the coolant at starting the internal combustion engine; and control means for circulating the coolant preferentially through the second flow passage via control over the adjusting means based on the measured temperature in a period in which circulation of the coolant is limited.

With the control device for a cooling system according to the invention, circulation of the coolant is limited by the operation of the limiting means at starting the internal combustion engine.

"Limiting" in the present application means a measure to suppress the cooling performance of the coolant such that a warm-up of the internal combustion engine is facilitated or the warm-up is not impaired as compared to the case where the limiting is not carried out. For example, the limiting means may prohibit circulation of the coolant or circulate a small amount of the coolant within the range smaller than or equal to an upper limit value given in advance in light of this kind of purpose at the time of limiting circulation of the coolant.

On the other hand, in the control device for a cooling system according to the invention, in the period in which circulation of the coolant is limited in terms of such facilitation of an engine warm-up, the adjusting means is controlled by the control means on the basis of the temperature of the coolant (hereinafter, referred to as "coolant temperature" where appropriate) measured by the measuring means. More specifically, the control means preferentially circulates the coolant through the second flow passage.

The second flow passage means a collection of the flow passages, including the engine cooling flow passage, the EGR cooling flow passage and the bypass flow passage and not including the radiator flow passage, within the coolant flow passages that are the components of the cooling system. That is, when the second flow passage is selected as the flow passage through which the coolant should be circulated, the coolant is circulated without being cooled by the radiator.

An average coolant temperature in the second flow passage does not have a significant difference from the temperatures of the cooled objects at the timing of a start; however, the average coolant temperature rises with an elapsed time from the timing of the start because heat is fed from relatively high-temperature portions, such as a cylinder head and a cylinder block. Therefore, particularly in a certain time region within a time region from immediately after starting to the timing corresponding to completion of the warm-up, the average coolant temperature is mostly higher than the temperature of EGR gas that stagnates around the EGR cooler of which a rise in temperature is slow. That is, for example, in this kind of time region, the coolant can have a property as a heat medium that feeds heat to the EGR cooler.

The control device for a cooling system according to the invention focuses on that point, and is able to further facilitate a warm-up of the EGR cooler while facilitating a warm-up of the internal combustion engine by circulating the coolant preferentially through the second flow passage in the period in which circulation of the coolant is limited in order to facilitate a warm-up of the internal combustion engine.

"Preferentially" is intended to allow a situation that a circulation amount of the coolant in the first flow passage is not necessarily zero. However, circulation of the coolant in the first flow passage is not meaningful from the viewpoint of warming up the internal combustion engine. In light of this point, circulation of the coolant in the first flow passage may be limited to zero or its corresponding value as a preferred embodiment. The term "preferentially" potentially means that a limited coolant circulation measure by the control means is coordinately carried out within the range in which the coolant circulation limiting measure by the limiting means in terms of an engine warm-up is not impaired. That is, the operation of the limiting means and the operation of the control means do not contradict with each other.

In this way, with the control device for a cooling system according to the invention, a coolant circulation limiting measure is carried out at starting in terms of facilitation of an engine warm-up, whereas a preferential coolant circulation measure to the second flow passage, which can achieve feeding of heat to the EGR cooler in terms of facilitation of a warm-up of the EGR cooler, is carried out. Thus, by achieving an early warm-up of the internal combustion engine as a whole and suppressing or reducing production of condensed water through a warm-up of the EGR cooler, it is possible to achieve introduction of EGR at starting as early as possible.

The adjusting means according to the invention is a concept including physical means for being able to adjust the circulation amount of the coolant in the first flow passage and the second flow passage, and can include a component, such as an electric W/P and a mechanical W/P, that can control the circulation amount of the coolant in the overall cooling system. Suitably, for example, a valve device, such as a CCV, which allows a selection of the flow passage from between the first flow passage and the second flow passage, may be included. The valve device may, for example, have a configuration that can change the flow passage areas of various flow passages communicating with the cooled objects in a binary, stepwise or continuous manner by mechanically or electrically driving valves provided as needed in the flow passages.

A practical mode in which the measuring means measures the coolant temperature is not limited. For example, the measuring means may be directly detecting means, such as a coolant temperature sensor, or may be a kind of processor or control device, which acquires a sensor value from this kind of directly detecting means. Alternatively, the measuring means may be means for estimating the coolant temperature froth, for example, an operating environment of the internal combustion engine at that timing or a history of change in operating condition after starting. A practical embodiment according to such coolant temperature estimation is variously known; however, in a state where coolant is not circulated or supplied, a local temperature difference easily occurs in the coolant temperature, so a sensor value may not always indicate an accurate coolant temperature depending on a location at which the sensor is installed. From this viewpoint, the configuration that estimates the coolant temperature is practically advantageous.

An engine body portion including the cylinder head and the cylinder block is exposed to a large thermal load from immediately after starting. Thus, even when heat for raising the coolant temperature in the EGR cooling flow passage is drawn, there is a low possibility that a warmed-up state of the internal combustion engine excessively deteriorates, so, with the second flow passage preferential measure, it is possible to raise the coolant temperature of the coolant that is used to warm up the EGR cooler without influencing a warm-up of the internal combustion engine.

In light of the positive effect of giving higher priority to the second flow passage the temperature region in which the second flow passage preferential pleasure is carried out (this temperature region is referred to as "first temperature region" where appropriate) is ideally a temperature region having a lower limit temperature at which the practical significance can be found in feeding the coolant to the EGR cooler. For example, when assuming the time at cold starting at which an ambient temperature is about below zero to several degrees Celsius, the first temperature region is desirably a temperature region higher than the coolant temperature at starting. This is because, in such a situation, an appropriate time is required for the internal combustion engine, including the cylinder head or the cylinder block, to accumulate heat and, if circulation of the coolant in the second flow passage is started immediately after starting, a warm-up time of the internal combustion engine may be excessively long.

On the other hand, conventionally, in light of the point that circulation control in consideration of the influence of this kind of condensed water is not executed at all, there is a relatively high flexibility in the circulation amount of the coolant in the first temperature region. For example, circulating means, such as an electric water pump (W/P), or the adjusting means, such as an OCV (coolant control valve) and a thermostat, may be controlled such that the maximum circulation amount is obtained at, for example, the timing at which the measured coolant temperature has reached the first temperature region. Alternatively, the circulation amount may be increased in accordance with a preset profile from the timing at which the coolant temperature has reached the lower limit value of the first temperature region. At this time, a mode of change in the circulation amount may be in a linear, nonlinear, stepwise or continuous manner.

The second flow passage preferential measure by the control means may be such that the degree of priority varies in a binary, stepwise or continuous manner on the basis of the measured coolant temperature. That is, in terms of the point that the second flow passage preferential measure intends to early warm up the EGR cooler to such a degree that it is possible to exclude, suppress or reduce the influence of condensed water as one preferred embodiment, the necessity to warm up the EGR cooler decreases with a rise in the coolant temperature. Thus, the control means may raise the degree of priority as the coolant temperature decreases.

In one aspect of the control device for a cooling system according to the invention, the limiting means prohibits circulation of the coolant before the coolant is circulated preferentially through the second flow passage by the control means.

According to this aspect, in a time region before, the second flow passage preferential measure takes effect, circulation of the coolant is stopped. Thus, in, for example, a case including the case where the adjusting means is an electric W/P, it is meaningful in terms that wasteful electric power consumption can be suppressed.

In one aspect of the control device for a cooling system according to the invention, the control means circulates the coolant only through the second flow passage.

According to this aspect, as one example of the aspect in which circulation of the coolant in the second flow passage is given higher priority, circulation of the coolant in the first flow passage is prohibited. Thus, it is possible to suitably facilitate an engine warm-up of the internal combustion engine in parallel with a warm-up of the EGR cooler, so it is remarkably effective in terms of reduction in emission.

When the internal combustion engine is considered separately between the cylinder head and the cylinder block, the cylinder head that accommodates a combustion chamber and an exhaust system is more easily exposed to a thermal load than the cylinder block.

In light of this point, the engine cooling flow passage may be split into a first portion flow passage that is subjected to cooling of the cylinder head and a second portion flow passage that is subjected to cooling of the cylinder block, and only the first portion flow passage may be included in the second flow passage that is utilized to warm up the EGR cooler. With this configuration, while a sufficient amount of heat that should be fed to the coolant that is circulated through the second flow passage is ensured, it is possible to suppress a decrease in the warm-up effect of the internal combustion engine due to the coolant in the second portion flow passage.

On the other hand, with such a configuration, furthermore, for example, at the time of selecting the first flow passage before or after the timing of completion of an engine warm-up, both the first and second portion flow passages may be configured to be included in the first flow passage. In this case, it is possible to further reliably prevent an overheat after an engine warm-up. The physical configuration of the flow passage portion and adjusting means that provide such an advantageous effect may be, of course, equivocal. The engine warm-up completion timing is not univocal in light of the fact that the timing varies in accordance with the definition of completion of an engine warm-up. Thus, determination regarding completion of an engine warm-up may be individually specifically carried out on the basis of a determination criterion given experimentally, empirically or theoretically in advance.

In another aspect of the control device for a cooling system according to the invention, the control means circulates the coolant such that the temperature of the coolant in the EGR cooling flow passage does not become lower than or equal to an exhaust gas dew-point temperature.

According to this aspect, the control means is configured to control the adjusting means on the basis of the temperature measured by the measuring means such that the coolant temperature in the EGR cooling flow passage does not become lower than or equal to the exhaust gas dew-point temperature at the time of circulating the coolant preferentially through the second flow passage.

Therefore, according to this aspect, it is possible to effectively suppress production of condensed water from EGR gas that stagnates near the EGR cooler particularly at an EGR non-introduction stage. Thus, it is possible to reduce the influence of condensed water on the EGR device, for example, the EGR gas flow passage, such as an EGR pipe.

The exhaust gas dew-point temperature means that moisture in exhaust gas condensates in a temperature region below that temperature. In light of the point that the coolant and EGR gas do not directly contact each other, the exhaust gas dew-point temperature that is an index of the coolant temperature in the EGR cooling flow passage is a temperature that can have an appropriate width with respect to the strict meaning exhaust gas dew-point temperature.

In another aspect of the control device for a cooling system according to the invention, the control means increases a circulation amount of the coolant in the second flow passage and then reduces the circulation amount after increasing the circulation amount in a period in which the coolant is circulated preferentially through the second flow passage.

According to this aspect, in process in which the second flow passage preferential measure is carried out by the control means, the circulation amount of the coolant in the second flow passage is increased. At this time, a mode of increase is not limited, and the circulation amount of the coolant in the second flow passage may be, for example, increased to the maximum value that can be achieved at that timing or may be increased in a binary, stepwise or continuous manner in accordance with a predetermined increasing profile (for example, the speed of increase, the rate of increase, an increasing curve, or the like).

On the other hand, the sensitivity of the coolant temperature in the EGR cooling flow passage to a variation in the circulation amount of the coolant in the second flow passage is not high. Therefore, if the coolant in the second flow passage, which has been once increased, is reduced again, an influence due to condensation is hard to become apparent.

On the other hand, circulation of the coolant in the second flow passage impairs a warm-up of the internal combustion engine. When the warm-up is insufficient, for example, thermal expansion of a cylinder bore in the cylinder block does not sufficiently advance, so a friction loss of a piston that repeats reciprocal motion in the cylinder bore relatively increases. A rise in lubricant temperature is also impaired, so a friction loss of the whole engine also tends to be relatively large. Thus, as a general tendency, the fuel consumption rate of the internal combustion engine tends to deteriorate.

In terms of this point, according to this aspect, it is possible to limit circulation of the coolant in the second flow passage within the range in which an adverse influence due to condensed water from EGR gas does not become apparent as much as possible and facilitate a warm-up of the internal combustion engine as much as possible. Thus, it is possible to attain both the effect of maintaining the EGR device, provided by corrosion prevention, or the like, of the EGR pipe, and the economic effect provided by improvement in fuel economy.

In another aspect of the control device for a cooling system according to the invention, the control means circulates the coolant through each of the first and second flow passages before completion of a warm-up of the internal combustion engine in a period in which the coolant is circulated preferentially through the second flow passage.

According to this aspect, before completion of a warm-up of the internal combustion engine, circulation of the coolant by using both the first flow passage and the second flow passage is started. That is, in the stage in which the internal combustion engine has completely shifted into a warmed-up state, the cooling effect of the coolant through the first flow passage including the radiator has been already obtained, and it is possible to suitably prevent occurrence of a problem due to mainly a thermal load, such as an overheat of the internal combustion engine.

Determination as to whether the engine warm-up has been completed can be carried out under various practical modes on the basis of the above-described various alternative indices. "Before completion of a warm-up" in this aspect means a time region before a determination criterion regarding completion of a warm-up is satisfied on the assumption that there is the determination criterion.

Control over circulation of the coolant using both the first and second flow passages may be executed within the bounds of the second flow passage preferential measure, or may be carried out after the second flow passage preferential measure is cancelled.

A practical mode regarding circulation of the coolant by using the first flow passage and the second flow passage is, of course, equivocal. For example, when the valve device that serves as the adjusting means is interposed at a portion downstream of the engine cooling flow passage, a plurality of output-side ports of the valve device may be provided, and one may be provided in correspondence with the radiator side and the other may be provided in correspondence with the EGR cooler side. In this case, when both the valves are open, a circulation passage from the engine to the radiator and a circulation passage from the engine to the EGR cooler are formed. In this way, the first flow passage and the second flow passage according to the invention may be partially shared.

In another aspect of the control device for a cooling system according to the invention, the control means controls a circulation amount of the coolant in the second flow passage on the basis of a controlling element corresponding to an EGR amount of the EGR device in a period in which the coolant is circulated preferentially through the second flow passage.

The "controlling element corresponding to the EGR amount" is a concept including the EGR amount itself, and suitably including an EGR valve opening degree, an EGR rate, and the like.

According to this aspect, the circulation amount of the coolant in the second flow passage is made variable on the basis of the controlling element corresponding to the EGR amount. The highest advantage of circulating the coolant preferentially through the second flow passage while circulation of the coolant is limited is to obtain the warm-up effect specific to the EGR cooler, and its purpose is to present production of condensed water.

Thus, as EGR gas that becomes a source to produce condensed water relatively increases, the necessity to warm up the EGR cooler increases; whereas, as EGR gas relatively reduces, the necessity to warm up the EGR cooler decreases. That is, according to this aspect, it is possible to optimize the circulation amount of the coolant in the second flow passage, so it is possible to obtain the warm-up effect of the internal combustion engine at the maximum.

A specific control example of the present aspect is not univocal, and, for example, a method, such as increasing or reducing the circulation amount of the coolant on the basis of the magnitude of the EGR amount and increasing or reducing the circulation amount of the coolant on the basis of the magnitude of the EGR valve opening degree, may be employed.

Practically, the EGR amount or the EGR rate is influenced by an intake air amount, a pressure difference between intake and exhaust systems; and the like, so the EGR valve opening degree can be relatively accurately acquired as a controlled amount although it remains in the realm of assumption. In terms of this point, from the viewpoint of reducing a load on the control means, the EGR valve opening degree is a preferred one as the controlling element in the present aspect.

In another aspect of the control device for a cooling system according to the invention, the cooled objects include an auxiliary other than the internal combustion engine or the EGR device, the flow passage portion includes an auxiliary cooling flow passage for cooling the auxiliary, the adjusting means includes a mechanical pump device that is driven by an engine torque of the internal combustion engine, and is further able to adjust a circulation amount of the coolant in a third flow passage including the auxiliary cooling flow passage and not including the engine cooling flow passage or the EGR cooling flow passage, and the control means circulates the coolant through the third flow passage in the period in which circulation of the coolant is limited.

There are various practical modes of the adjusting means in the invention, and, for example, an electric W/P, a mechanical W/P, or the like, can be suitably used.

The mechanical W/P differs from the electric W/P, and contrarily increases its driving load in a state where the coolant is not circulated. The mechanical W/P is driven by using the engine torque of the internal combustion engine, so fuel economy tends to deteriorate as the driving load of the pump increase.

Thus, in the configuration that the coolant is circulated by the mechanical W/P, the minimum circulation amount is desirably consistently allowed. Incidentally, circulation of the coolant is not desirable in a warm-up incompletion period of the internal combustion engine because the warm-up is impaired.

In terms of this point, according to this aspect, in the period in which circulation of the coolant is limited, particularly, in a period before the second flow passage preferential measure is carried out, it is possible to circulate the coolant through the third flow passage including the auxiliary cooling flow passage and not including the engine cooling flow passage or the EGR cooling flow passage. Thus, it is possible to suitably reduce the driving load of the pump and to suppress deterioration of fuel economy of the internal combustion engine.

Such operations and other advantages of the invention are become apparent from embodiments described below.

MODES FOR CARRYING OUT THE INVENTION

Embodiments of the Invention

First Embodiment

Configuration of Embodiment

Figure 1:
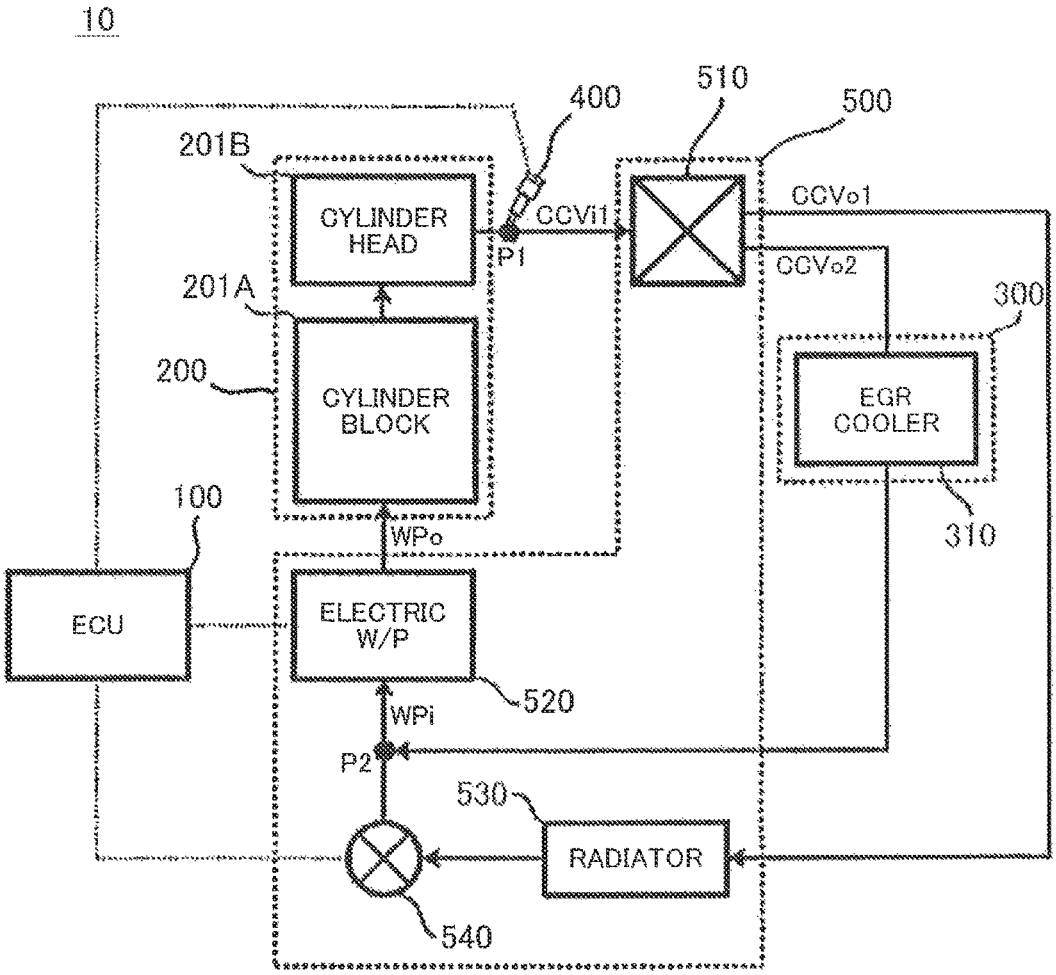
FIG. 1 is a block diagram of an engine system according to a first embodiment of the invention.

First, the configuration of an engine system 10 according to a first embodiment of the invention will be described with reference to FIG. 1. FIG. 1 is a block diagram of the engine system 10.

In FIG. 1, the engine system 10 is a system mounted on a vehicle (not shown), and includes an ECU (electronic control unit) 100, an engine 200, an EGR device 300, a coolant temperature sensor 400 and a cooling device 500.

The ECU 100 includes a CPU (central processing unit), a ROM (read only memory), a RAM (random access memory) (which are not shown), and the like, and is configured to be able to control the overall operation of the engine system 10. The ECU 100 is a computer device that is an example of a "control device for a cooling system" according to the invention.

Figure 2:
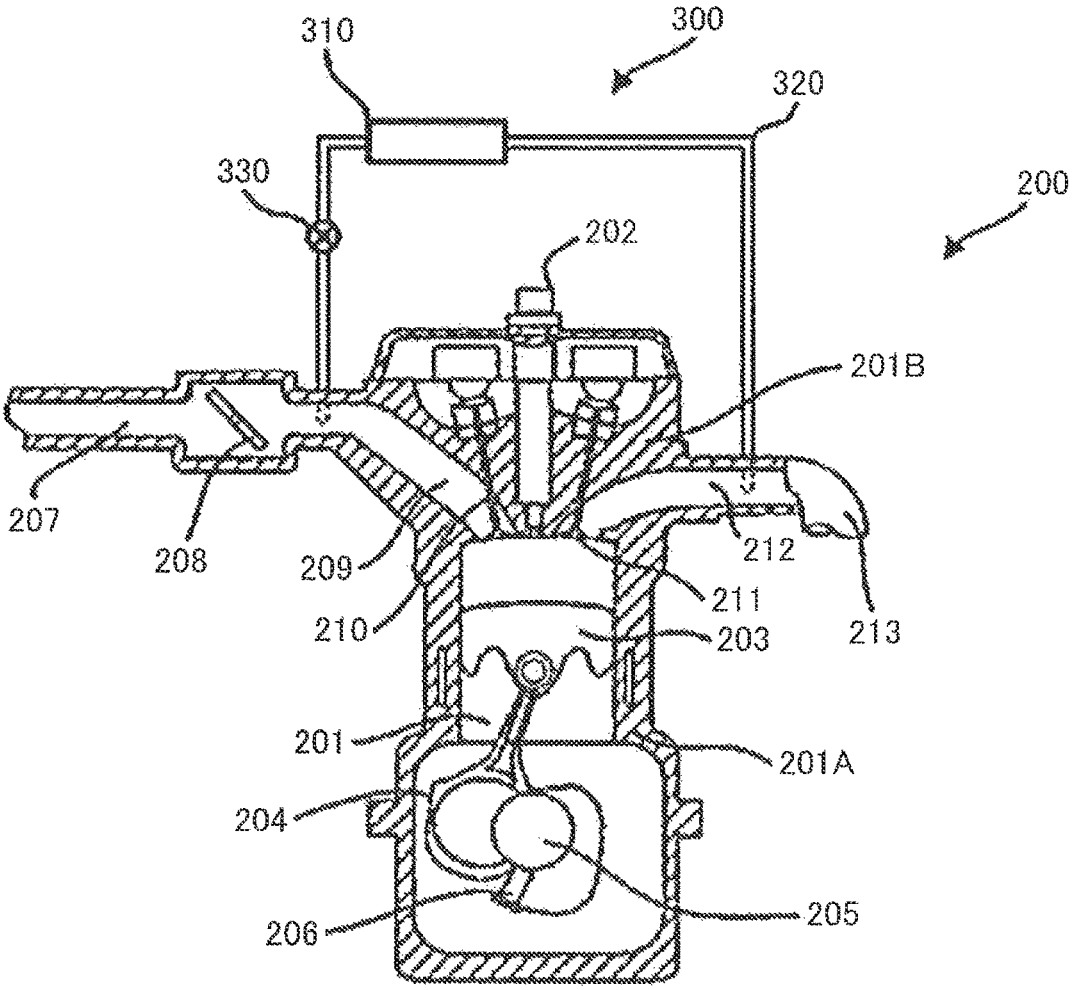
FIG. 2 is a schematic cross-sectional view of an engine in the engine system shown in FIG. 1.

The engine 200 is a diesel engine (compression self-ignition internal combustion engine) that is an example of an "internal combustion engine" according to the invention. The detailed configuration of the engine 200 will be described with reference to FIG. 2. FIG. 2 is a schematic cross-sectional view of the engine 200. In FIG. 2, like reference numerals denote portions that overlap with those in FIG. 1, and the description thereof is omitted where appropriate.

In FIG. 2, the engine 200 has a configuration such that a cylinder 201 is formed in a metal cylinder block 201A.

Part of a fuel injection valve of a direct-injection injector 202 is exposed to a combustion chamber formed inside the cylinder 201, and is configured to be able to supply high-pressure fuel spray into the combustion chamber. A piston 203 is provided inside the cylinder 201 so as to be reciprocally movable. The reciprocal motion of the piston 203, which occurs because of self-ignition of air-fuel mixture of fuel (light oil) and intake air in a compression stroke, is configured to be converted to the rotational motion of a crankshaft 205 via a connecting rod 204.

A crank position sensor 206 is installed near the crankshaft 205. The crank position sensor 206 detects the rotation angle of the crankshaft 205. The crank position sensor 206 is electrically connected to the ECU 100. A detected crank angle is configured to be supplied to the ECU 100 at constant or inconstant intervals. The ECU 100 is configured to control the fuel injection timing, and the like, of the direct-injection injector 202 on the basis of the crank angle detected by the crank position sensor 206. The ECU 100 is configured to be able to calculate the engine rotation speed NE of the engine 200 by temporally processing the detected crank angle.

In the engine 200, air taken in from the outside passes through an intake pipe 207, sequentially passes through a throttle valve 208 and an intake port 209, and is taken into the inside of the cylinder 201 at the time when an intake valve 210 is open.

Air-fuel mixture combusted inside the cylinder 201 becomes exhaust gas, and is configured to be guided to an exhaust pipe 213 via an exhaust port 212 at the time when an exhaust valve 211 is open. The exhaust valve 211 opens or closes in interlocking with the open/close of the intake valve 210. The exhaust port 212 and an exhaust manifold (not shown) are accommodated in a cylinder head 201B. The exhaust manifold is interposed between the exhaust port 212 and the exhaust pipe 213.

On the other hand, one end of an EGR pipe 320 formed of a metal material is connected to the exhaust pipe 213. The other end of the EGR pipe 320 is coupled to the intake port 209 at a portion downstream of the throttle valve 208. Part of exhaust gas is configured to be returned to an intake system as EGR gas.

An EGR cooler 310 is provided in the EGR pipe 320. The EGR cooler 310 is a cooling device for EGR gas, provided in the EGR pipe 320, and a water jacket in which coolant is encapsulated is running around. The EGR cooler 310 is configured to be able to cool EGR gas by exchanging heat with the coolant.

An EGR valve 330 is provided in the EGR pipe 320 at a portion downstream of the EGR cooler 310. The EGR valve' 330 is an electromagnetically driven valve, and is configured such that its valve opening degree continuously varies through energization of a solenoid via the ECU 100. The flow rate of EGR gas flowing through the EGR pipe 310, that is, an EGR amount, continuously varies with a differential pressure between the intake pipe 207 and the exhaust pipe 213, and the valve opening degree.

The EGR pipe 320, the EGR cooler 310 and the EGR valve 330 constitute the EGR device 300 of the engine system 10. The EGR device 300 is an example of an EGR device according to the invention.

Various configurations other than the illustrated one are applicable as the configuration of the EGR device. For example, the EGR device 300 according to the present embodiment has a configuration such that exhaust gas immediately after combustion is returned (that is, HPL (high pressure loop) EGR). Instead, the EGR device 300 may have a configuration such that exhaust gas is taken out at a portion downstream of an exhaust, emission control device, such as a DPF (diesel particulate filter) (not shown) (that is, LPL (low pressure loop) EGR).

Referring back to FIG. 1, the coolant temperature sensor 400 is a sensor configured to be able to detect a coolant temperature Tcl that is the temperature of LLC (long life coolant) that is a coolant. The coolant temperature sensor 400 is installed in a flow passage CCVi1 coupled to an input port of the CCV 510 (described later) among coolant flow passages (described later), and is able to detect the coolant temperature Tcl in the flow passage. CCVi1. The coolant temperature sensor 400 is electrically connected to the ECU 100. The ECU 100 is able to constantly read the detected coolant temperature Tcl.

The cooling device 500 is an example of a "cooling system" according to the invention, and cools cooled objects, that is, the engine 200 and the EGR device 300, by circulating and supplying coolant encapsulated in the flow passages through a flow passage selected as needed by the operation of the CCV 510 (described later).

The cooling device 500 includes the CCV 510, an electric water pump (hereinafter, referred to as "electric W/P" where appropriate) 520, a radiator 530, a thermostat 540 and flow passages (CCVi1, CCVo1, CCVo2, WPi and WPo) indicated by the continuous lines in the drawing.

The flow passage. CCVi1 is a coolant flow passage including the water jacket (not shown) that sequentially passes' through the cylinder block 201A and the cylinder head 201B, and is an example of an "engine cooling flow passage" according to the invention. The flow passage CCVi1 is connected to the input port of the CCV 510.

The flow passage CCVo1 is a coolant flow passage connected to a first output port of the CCV 510. The flow passage CCVo1 is connected to the thermostat 540. The flow passage CCVo1 is an example of a "radiator flow passage" according to the invention.

The flow passage CCVo2 is a coolant flow passage connected to a second output port of the CCV 510. The flow passage CCVo2 is connected to a flow passage WPi at a connection point P2. The flow passage CCVo2 includes the water jacket of the above-described EGR cooler 310, and is an example of an "EGR cooling flow passage" according to the invention.

In the present embodiment, the flow passage for cooling the EGR cooler 310 is isolated from the radiator 530 and is independent. The flow passage CCVo2 is configured to also function as an example of a "bypass flow passage" according to the invention.

The flow passage WPi is a coolant flow passage connected to an input-side port of the electric W/P 520.

The flow passage WPo is a coolant flow passage connected to an output-side port of the electric W/P 520. The flow passage WPo is connected to the flow passage CCVi1 (an inlet portion at the cylinder block 201A side in the drawing).

The CCV 510 is an electromagnetic control valve device that is able to switch the flow passage through which coolant is circulated (so to speak, an active flow passage) in response to each operation mode (described later) of the cooling device 500, and is an example of "adjusting means" according to the invention.

In the CCV 510, the input port that is a coolant input-side interface is connected to the above-described flow passage. CCVi1, and, of the output ports that are two output-side interfaces, the first output port is connected to the flow passage CCVo1 and the second output port is connected to the flow passage CCVo2.

The CCV 510 is able to distribute coolant, which is input via the input port, to the output ports. More specifically, the CCV 510 includes known solenoids, driving devices and valves. Each of the solenoids generates electromagnetic force by exciting current. Each of the driving devices supplies the exciting current. Each of the valves is arranged at a corresponding one of the output ports, and its valve opening degree continuously varies with the electromagnetic force. The opening degrees of the valves are allowed to be varied independently of each other.

Each valve opening degree is directly proportional to the flow passage area of a corresponding one of the output ports. The case where the valve opening degree is 100(%) corresponds to a fully open state, and the case where the valve opening degree is 0(%) corresponds to a fully closed state. That is, the CCV 510 is able to substantially freely control the circulation amount (that is, the feed rate) of coolant in the selected flow passage in addition to the function of selecting the coolant flow passage. Each of the above driving devices is electrically connected to the ECU 100, and the operation of the CCV 510 is substantially controlled by the ECU 100.

The electric W/P 520 is a known electrically driven centrifugal pump. The electric W/P 520 is configured to be able to draw coolant, which is input from the flow passage WPi via the input port, by the rotational force of a motor (not shown) and discharge coolant in an amount corresponding to a motor rotation speed Nwp to the flow passage WPo via the output port. Thus, the electric W/P 520 is able to adjust the circulation amount of coolant in the flow passage that is selected as needed by the CCV 510, and the electric W/P 520 also constitutes an example of the "adjusting means" according to the invention.

The motor is configured to receive electric power that is fed from an electric power feeding source (not shown) (for example, an in-vehicle 12V battery or another battery), or the like. A pump rotation speed Nwp that is the rotation speed of the motor is configured to be controlled to increase or decrease in response to a duty ratio DTY of a control voltage (or a control current) that is fed via a motor driving system (not shown).

The motor driving system is in a state electrically connected to the ECU 100, and is configured such that its operating state including the above-described duty ratio DTY is controlled by the ECU 100. That is, the electric W/P 520 is configured such that its operating state is controlled by the ECU 100.

The radiator 530 is a known cooling device, that is formed such that a plurality of water pipes that communicate with an inlet pipe and an outlet pipe are arranged and a large number of corrugated fins are provided on the outer peripheries of the water pipes. The radiator 530 is configured to guide coolant, flowing in from the inlet pip, to the water pipes and draw heat from coolant by exchanging heat with atmosphere via the fins in process in which the coolant flows through the water pipes. Coolant relatively cooled through drawing of heat, is configured to be drained from the outlet pipe.

The thermostat 540 is a known temperature regulating valve configured to open at a preset temperature (for example, about 80 degrees Celsius). Because the thermostat 540 is connected to the flow passage CCVo1, the flow passage CCVo1 is opened at the set temperature of about 80 degrees Celsius in the present embodiment. The thermostat 540 together with the CM 510 constitutes an example of the "adjusting means" according to the invention.

In this way, in the cooling device 500 according to the present embodiment, the flow passages WPo, WPi and CCVi1 and the flow passage CCVo1 constitute a first flow passage that is an example of a "first flow passage" according to the invention. The flow passages WPo, WPi, CCVi1 and CCVo2 constitute a second flow passage that is an example of a "second flow passage" according to the invention. That is, in the present embodiment, the flow passages WPi, WPo and CCVi1 are shared between the first and second flow passages.

Operation of Embodiment

Next, the operation of the cooling device 500 will be described with reference to the drawings as needed as the operation of the embodiment. The cooling device 500 has three types of operation modes, that is, operation modes M1, M2 and M3, and is configured such that the flow passage for circulating coolant changes in response to the selected operation mode. A selection of the operation mode is configured to be executed by the ECU 100 that functions as an example of "measuring means", "limiting means" and "control means" according to the invention on the basis of the coolant temperature Tcl that is detected by the coolant temperature sensor 400.

Figure 3:
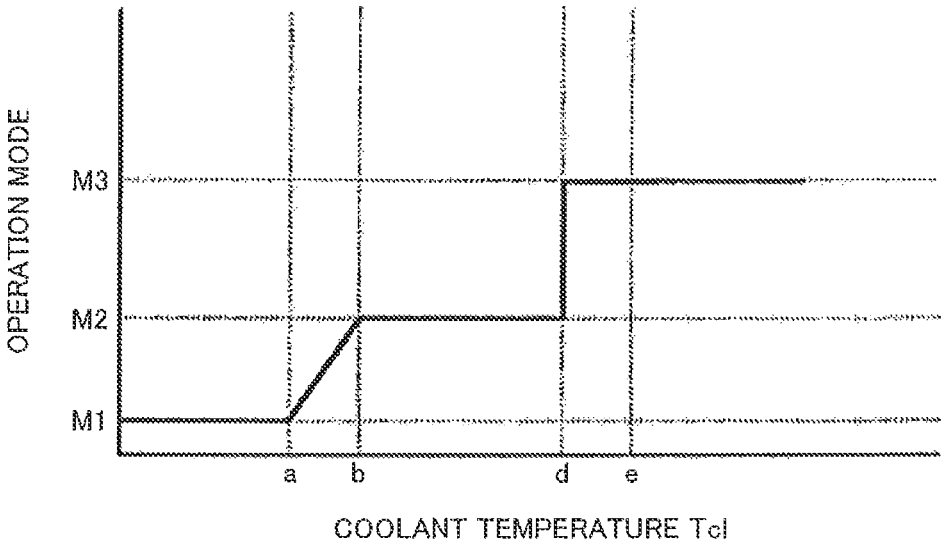
FIG. 3 is a view that illustrates the correlation between an operation mode of a cooling device and a coolant temperature.

The relationship between the operation mode of the cooling device 500 and the coolant temperature Tcl will be described with reference to FIG. 3. FIG. 3 is a view that illustrates the correlation between a coolant temperature Tcl and an operation mode to be selected. In FIG. 3, the ordinate axis corresponds to the operation mode, and the abscissa axis corresponds to the coolant temperature Tcl.

In FIG. 3, when the coolant temperature Tcl is lower than a preset temperature value a, the ECU 100 selects the operation mode M1 as the operation mode of the cooling device 500.

The operation mode M1 is a mode in which the two output ports of the CCV 510 are kept in a closed state through control over the valve opening degrees. In the operation mode M1, because the output ports of the CCV 510 are in the closed state, coolant stagnates while being encapsulated in the flow passages without circulating. That is, in the operation mode M1, an example of a state where "circulation of coolant is limited" according to the invention is achieved. In the state where the operation mode M1 is selected, the electric W/P 520 is kept in a stopped state.

The temperature value a is a temperature set on a higher temperature side than the coolant temperature Tcl at cold starting experimentally, empirically or theoretically in advance. Thus, at cold starting, the operation mode of the cooling device 500 is kept in the operation mode M1 in an interim period from the timing of starting.

When the coolant temperature Tcl reaches the temperature value a, the ECU 100 gradually increases the second output port-side valve opening degree of the CCV 510, thus gradually increasing the flow passage area of the flow passage CCVo2. At this time, the valve opening degree is continuously variable on the basis of the coolant temperature Tcl. The increase in the flow passage area of the flow passage CCVo2 is continued until the coolant temperature Tcl becomes a temperature value b (b>a).

On the other hand, in an interim period from when the coolant temperature Tcl has reached the temperature value b to when the coolant temperature Tcl reaches a temperature value d (d>b), the ECU 100 selects the operation mode M2 as the operation mode of the cooling device 500. In the operation mode M2, while the flow passage CCVo1 is kept in the closed state, the flow passage CCVo2 is kept in a fully open state in which a maximum flow rate is obtained.

As a result, in a state where the operation mode M2 is selected, coolant circulates via the flow passage WPo, the flow passage CCVi1, the flow passage CCVo2 and the flow passage WPi because of the operation of the electric W/P 520. That is, coolant circulates through the second flow passage.

In a transitional temperature region higher than or equal to the temperature value a and lower than the temperature value b as well, it differs only in that the circulation amount of coolant varies; however, it is similar in that coolant circulates through the second flow passage, and the operation mode of the cooling device 500 is the operation mode M2 in a broad sense.

In this way, in a temperature region in which the coolant temperature Tcl is higher than or equal to the temperature value a and lower than a temperature value d, at least circulation of coolant through the second flow passage is given higher priority than that through the first flow passage. That is, an example of the operation of the control means according to the invention is achieved. The temperature region higher than or equal to the temperature value a and lower than the temperature value d is an example of a "first temperature region" described above.

Here, the temperature value b is an example of an exhaust gas dew-point temperature according to the invention, and is set as a temperature value at which EGR gas in the flow passage is excessively cooled to produce condensed water (which does not always correlate with whether condensed water is actually produced). That is, by feeding heat to the EGR cooler 310 via coolant in the temperature region higher than or equal to the temperature value a, the temperature of EGR gas that stagnates around the EGR cooler 310 is ideally kept in the temperature region higher than or equal to the temperature value b. In addition, in the present embodiment, the operation mode M2 is selected before the coolant temperature Tcl reaches the temperature value b, so the temperature of EGR gas quickly shifts into the temperature region higher than or equal to the temperature value b. Thus, by selecting the operation mode M2, production of condensed water near the EGR cooler 310 is adequately prevented, so it is possible to effectively prevent corrosion, or the like, of the EGR pipe 320.

The second flow passage is a flow passage that does not pass through the radiator 530, and is a flow passage in which heat stored by coolant is kept so as not to be released as much as possible. Thus, even when heat is fed to the EGR cooler 310, there is no concern that a warm-up of the engine 200 is significantly impaired.

The ECU 100 determines whether to circulate coolant through the second flow passage and how much coolant is circulated on the basis of the degree of a warm-up effect of the EGR cooler 310, which is obtained through circulation of coolant through the second flow passage. That is, in the temperature region lower than the temperature value a, in which circulation of coolant is stopped, because the amount of heat stored in coolant is small, a high warm-up effect on the EGR cooler 310 cannot be desired even when the second flow passage is selected. On the other hand, when the coolant temperature Tcl reaches the temperature region higher than the exhaust gas dew-point temperature, there is a small concern that the coolant temperature in the flow passage CCVo2 decreases to the exhaust gas dew-point temperature or below.

The temperature value a that gives a reference at the time when the ECU 100 controls the operation state of the CCV 510 is determined in terms of such viewpoint, and it is practically significantly advantageous in terms of making it possible to effectively maintain the EGR device 300 while keeping the warm-up effect of the engine 200 as much as possible.

On the other band, when the coolant temperature Tcl reaches the temperature value d in its rising process, the ECU 100 selects the operation mode M3 as the operation mode of the cooling device 500. In the operation mode M3, both the valves arranged respectively at the two output ports of the CCV 510 are set in the fully open state, and the flow passage CCVo1 and the flow passage CCVo2 each are set in a state where the maximum flow rate at that timing is obtained. That is, the priority relationship of the flow passage CCVo2 over the flow passage. CCVo1 substantially disappears, and both the flow passages have an equal relationship.

As a result, in a state where the operation mode M3 is selected, coolant circulates through the second flow passage that passes through the flow passage WPo, the flow passage CCVi1 (engine 200), the flow passage CCVo2 (EGR cooler 310) and the flow passage WPi and the first flow passage that passes through the flow passage WPo, the flow passage CCVi1 (engine 200), the flow passage CCVo1 (radiator 530), the thermostat 540 and the flow passage WPi because of the operation of the electric W/P 520.

The temperature value d is set to a value lower than a warm-up temperature value e (for example, 80 degrees Celsius) that is a temperature at which it may be determined that the engine 200 has shifted into a warmed-up state, and safer-side consideration is given. That is, when cooling operation of the radiator 530 is made active in the temperature region lower than the warm-up temperature value in this way, the possibility of an overheat of the engine 200 remarkably decreases as compared to the case where the operation mode M3 is selected in the temperature region higher than or equal to the warm-up temperature value.

In the present embodiment, the circulation amount of coolant in the operation mode M2 is obtained by merely using only the coolant temperature Tcl as a reference value. However, in light of the point that the purpose of circulating coolant through the second flow passage is preventing condensation of EGR gas, the circulation amount of coolant may be corrected as needed on the basis of the EGR amount or EGR rate of the EGR device 300. More specifically, the following configuration may be employed. A correction coefficient (for example, the maximum value is 1) of the circulation amount is determined such that the circulation amount of coolant increases as the EGR amount increases or the EGR amount increases, and the correction coefficient is multiplied by the circulation amount obtained on the basis of the coolant temperature Tcl.

With this configuration, a situation in which the EGR cooler 310 is unnecessarily warmed up is prevented, so it is possible to further suitably facilitate a warm-up of the engine 200.

The circulation amount of coolant may be controlled on the basis of the EGR valve opening degree in the EGR device 300. That is, the circulation amount of coolant may be varied to increase or decrease in a binary, stepwise or continuous manner on the basis of the magnitude of the EGR valve opening degree. The EGR valve opening degree is a controlled amount such that its magnitude corresponds to the magnitude of the EGR amount as described above, and is suitable as an example of a "controlling element corresponding to an EGR amount" according to the invention. In comparison with the case where the EGR amount or the EGR rate is estimated, the EGR valve opening degree is, for example, allowed to be directly detected by an opening degree sensor, or the like, so high accuracy is expected, and a load in terms of control is small. In light of the purpose of preventing an unnecessary warm-up of the EGR cooler 310, the magnitude of the EGR amount just needs to roughly correspond to the magnitude of the circulation amount of coolant, so controlling the circulation amount of coolant on the basis of the EGR valve opening degree can also be a preferred embodiment of this kind of control.

Second Embodiment

Figure 4:
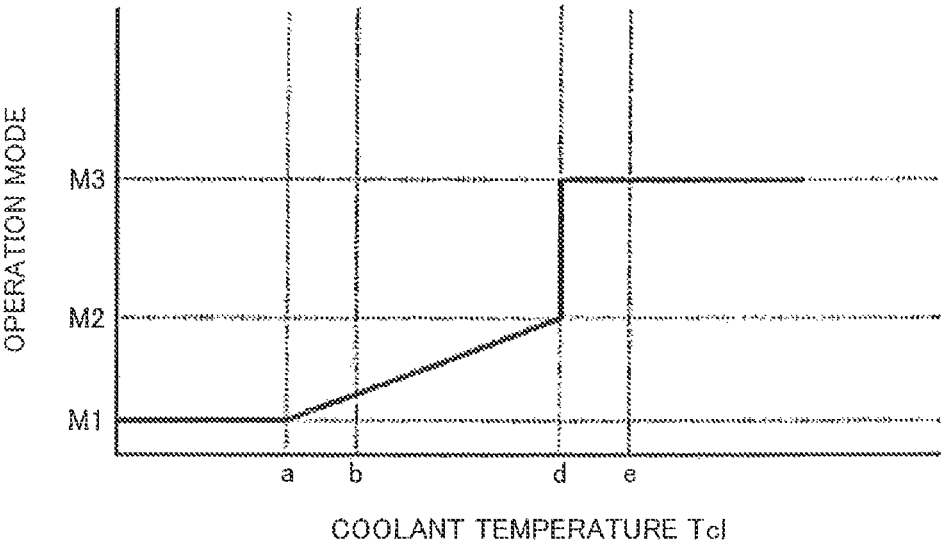
FIG. 4 is a view that illustrates the correlation between an operation mode of a cooling device and a coolant temperature according to a second embodiment of the invention.

Next, another mode for controlling the operation mode of the cooling device 500 will be described with reference to FIG. 4 as a second embodiment of the invention. FIG. 4 is a view that illustrates the correlation between a coolant temperature Tcl and an operation mode to be selected according to the second embodiment of the invention. In the drawing, like reference signs are assigned to portions that overlap with those in FIG. 3, and the description thereof is omitted where appropriate.

In FIG. 4, a gradual change from the operation mode M1 to the operation mode M2 is started at the timing at which the coolant temperature Tcl has reached the temperature value a, and the operation mode M3 is selected at the timing at which the coolant temperature Tcl has reached the temperature value d. This point is the same as the mode for selecting the operation mode according to the first embodiment. The second embodiment differs from the first embodiment in that the circulation amount of coolant is linearly increased in a time region from the temperature value a to the temperature value d.

As is apparent from the comparison between FIG. 3 and FIG. 4, the coolant circulation amount of the second flow passage at one coolant temperature in the temperature range from the temperature value a to the temperature value d is smaller in the second embodiment than in the first embodiment. That is, in the second embodiment, a warm-up of the engine 200 is more emphasized as compared to the first embodiment. Thus, according to the second embodiment, it is possible to facilitate a reduction in friction loss of the piston through a warms-up of a cylinder bore and a reduction in friction loss due to an early rise in lubricant temperature, so it is possible to effectively reduce the fuel consumption of the engine 200.

On the other hand, when the warm-up effect of the EGR cooler 310 is observed, the basic configuration that circulates coolant preferentially through the second flow passage in a predetermined temperature region including the exhaust gas dew-point temperature remains unchanged, and, when compared to the case where no measures are taken, it is possible to suppress production of condensed water at practically non-problematic level even with the present embodiment.

Third Embodiment

Figure 5:
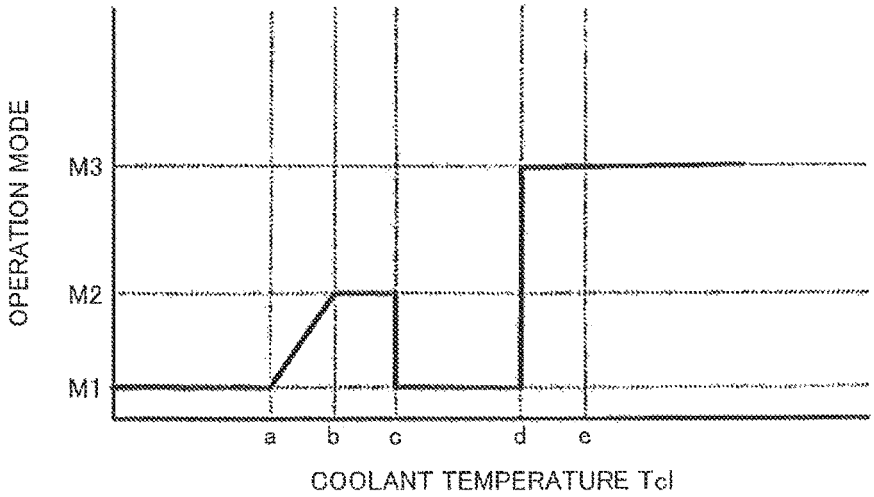
FIG. 5 is another view that illustrates the correlation between an operation mode of a cooling device and a coolant temperature according to a third embodiment of the invention.

Another mode for controlling the operation mode of the cooling device 500 will be described with reference to FIG. 5 as a third embodiment of the invention. FIG. 5 is a view that illustrates the correlation between a coolant temperature Tcl and an operation mode to be selected according to the third embodiment of the invention. In the drawing, like reference signs are assigned to portions that overlap with those in FIG. 3, and the description thereof is omitted where appropriate.

In FIG. 5, a gradual change from the operation mode M1 to the operation mode M2 is started at the timing at which the coolant temperature Tcl has reached the temperature value a, and the coolant circulation amount of the second flow passage is maximized at the timing at which the coolant temperature Tcl has reached the temperature value b. This point is the same as the mode for selecting the operation mode according to the first embodiment. The third embodiment differs from the first embodiment in the mode for selecting the operation mode after the temperature value b has been reached.

That is, in the first embodiment, the operation mode M2 is continuously selected in the period from when the coolant temperature Tcl has reached the temperature value b to when the coolant temperature Tcl reaches the temperature value d; whereas, in the third embodiment, the period is reduced to a period up to when the temperature value c ($b<c<d$) is reached. When the coolant temperature Tcl reaches the temperature value c, the ECU 100 returns the operation mode of the cooling device 500 to the operation mode M1 again, and switches the operation mode from the operation mode M1 straight to the operation mode M3 when the coolant temperature Tcl reaches the temperature value d. That is, such flow passage switching is an example of the operation of the control means for "increasing the circulation amount of coolant in the second flow passage and reducing the circulation amount after increasing the circulation amount in a period in which coolant is circulated preferentially through the second flow passage" according to the invention.

With such a mode for selecting the operation mode according to the third embodiment, the circulation amount of coolant while the coolant temperature Tcl falls between the temperature value a and the temperature value c is ensured by a larger amount than that of the second embodiment. On the other hand, at the timing at which the coolant temperature Tcl has reached the temperature value c at which it can be determined that a sufficient amount of heat for warming up the EGR cooler 310 is ensured, the operation mode is returned to the operation mode M1. Therefore, according to the present embodiment as well, as in the case of the second embodiment, it is possible to obtain such an effect that a friction loss due to facilitation of a warm-up of the cylinder bore is reduced and a friction loss due to a rise in lubricant temperature is reduced.

Particularly, according to the third embodiment, while the warm-up effect of the EGR cooler 310 is ensured, it is possible to extend the period in which the operation mode M1 is selected as compared to the first and second embodiments. Although the control load of the ECU 100 increases, it is possible to most efficiently warm up the engine 200.

In the present embodiment, as an example of the operation of the control means for "increasing the circulation amount of coolant in the second flow passage", the circulation amount of coolant in the second flow passage is increased to a value corresponding to the maximum value at that fitting in accordance with the operation mode M2. As an example of the operation of the control means for "reducing the circulation amount after increasing the circulation amount", circulation of coolant in the second flow passage is prohibited in accordance with the operation mode M1. However, this is one example.

That is, in the period in which coolant is circulated preferentially through the second flow passage, the effect of reducing the circulation amount after increasing the circulation amount is to ensure the warm-up operation of the EGR device and then facilitate an engine warm-up as much as possible as described above. As long as this point is obtained, the circulation amount of coolant in the second flow passage in the operation mode M2 does not need to be the maximum value, and circulation of coolant in the second flow passage in the operation mode M1 does not need to be prohibited. At this time, a similar advantageous effect is obtained when another operation mode based on such a concept is additionally set.

Fourth Embodiment

Next, a fourth embodiment of the invention will be described. In the fourth embodiment, the fact that the physical configuration of the cooling device that can prevent production of condensed water near the EGR cooler 310 at starting the engine 200 is not limited to the configurations illustrated in the first to third embodiments becomes apparent.

Figure 6:
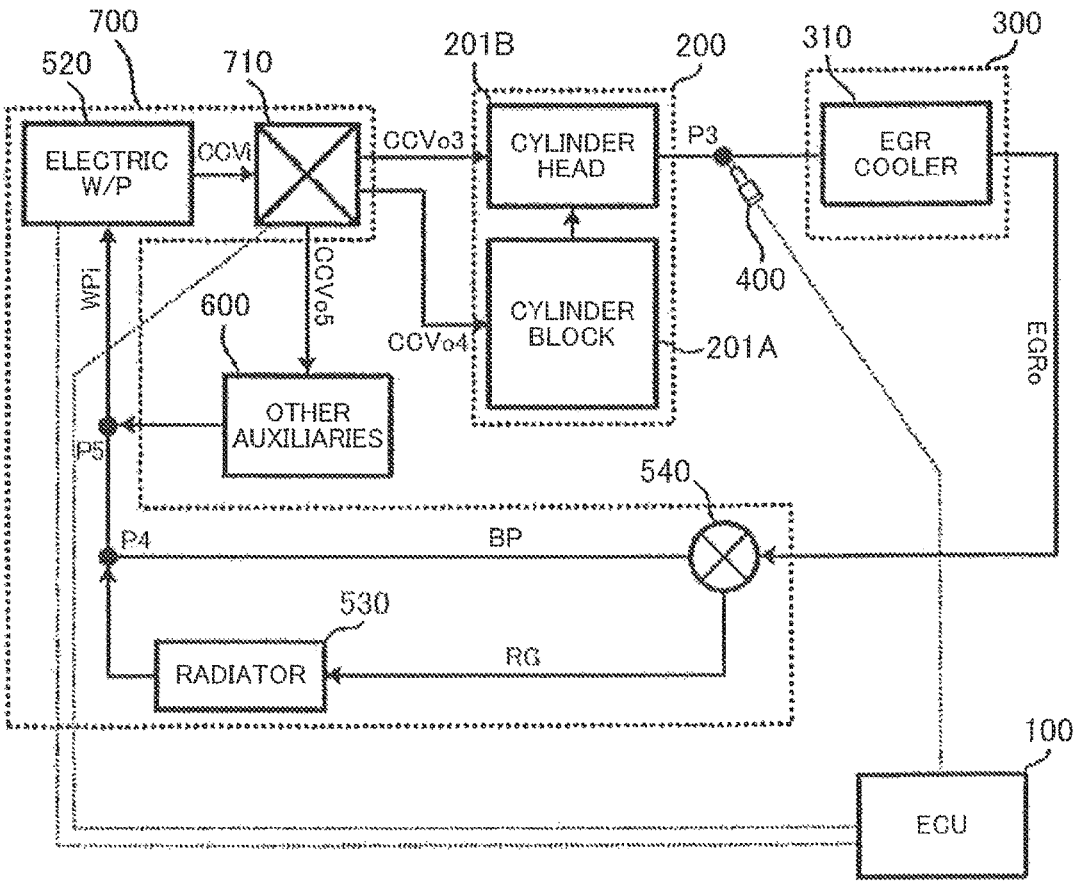
FIG. 6 is a block diagram of an engine system according to a fourth embodiment of the invention.

An engine system 20 according to the fourth embodiment of the invention will be described with reference to FIG. 6. FIG. 6 is a block diagram of the engine system 20. In the drawing, like reference numerals are assigned to portions that overlap with those in FIG. 1, and the description and drawing thereof are omitted where appropriate.

The engine system 20 mainly differs from the engine system 10 in that a cooling device 700 is provided instead of the cooling device 500 and other auxiliaries 600 are provided.

The other auxiliaries 600 are a collection of functional devices that require cooling by coolant, other than the engine 200 or the EGR device 300, in the vehicle. The other auxiliaries 600, for example, can include a driving device, such as a motor and an actuator, and a power supply, such as a battery.

The cooling device 700 differs from the cooling device 500 in that a CCV 710 is provided instead of the CCV 510. The cooling device 500 is changed to the cooling device 700, so the flow passage configuration is also changed. More specifically, the Cooling device 700 includes flow passages CCVi, CCVo3, CCVo4, CCVo5, EGRo, RG, BP and WPi as the coolant flow passages.

The flow passage CCVi is a coolant flow passage connected to the output port of the electric W/P 520 and the input port of the CCV 710.

The flow passage CCVo3 is a coolant flow passage connected to a first output port of the CCV 710 and including a water jacket (not shown) that passes through the cylinder head 201B, and is another example of the "engine cooling flow passage" according to the invention.

The flow passage CCVo4 is a coolant flow passage connected to a second output port of the CCV 710 and including a water jacket (not shown) that passes through the cylinder block 201A, and is another example of the "engine cooling flow passage" according to the invention. The flow passage. CCVo4 is connected to the flow passage CCVo3 (the water jacket of the cylinder head 201B in the drawing) at a portion downstream of the cylinder block 201A.

The flow passage CCVo5 is a coolant flow passage connected to a third output port of the CCV 710 and connected to the other auxiliaries 600, and is an example of an "auxiliary cooling flow passage" according to the invention. The other auxiliaries 600 are auxiliary devices that require cooling by coolant, other than the engine 200 or the EGR device 300. For example, the other auxiliaries 600 include a DPF installed in an exhaust passage of the engine 200, various electrical driving devices, a computer system, and the like. The flow passage CCVo5 is connected to the flow passage WPi at a connection point P5.

The flow passage EGRo is a coolant flow passage including a water jacket (not shown) that passes through the EGR cooler 310, and is another example of the "EGR cooling flow passage" according to the invention. The flow passage EGRo and the above-described flow passage CCVo3 are connected to each other at a connection point P3. In the present embodiment, the coolant temperature sensor 400 is configured to detect the coolant temperature Tcl at the connection point P3. The flow passage EGRo is connected to the thermostat 540 at an end different from the connection point P3.

The flow passage RG is a coolant flow passage connected to the thermostat 540 and the flow passage WPi. The flow passage RG is another example of the "radiator flow passage" according to the invention. The flow passage RU is connected to the flow passage WPi at a connection point P4. The flow passage WPi is similar to that of the above-described embodiments.

The flow passage BP is a coolant flow passage connected to the thermostat. 540 and the flow passage WPi. The flow passage RG is another example of the "bypass flow passage" according to the invention.

A large difference of the cooling device 700 from the cooling device 500 is that the CCV 710 that is an example of the "adjusting means" according to the invention is located at a portion upstream of the engine 200 in the coolant circulation passage.

In the CCV 710, the input port that is an input-side interface for coolant is connected to the above-described flow passage CCVi, and, of the output ports that are three output-side interfaces, the first output port is connected to the flow passage CCVo3, the second output port is connected to the flow passage CCVo4 and the third output port is connected to the flow passage CCVo5.

The CCV 710 is able to distribute coolant, which is input via the input port, to the output ports. More specifically, the CCV 710 includes known solenoids, driving devices and valves. Each of the solenoids generates electromagnetic force by exciting current. Each of the driving devices supplies the exciting current. Each of the valves is arranged at a corresponding one of the output ports, and its valve opening degree continuously varies with the electromagnetic force. The opening degrees of the valves are allowed to be varied independently of each other.

Each valve opening degree is directly proportional to the flow passage area of a corresponding one of the output ports. The case where the valve opening degree is 100(%) corresponds to a fully open state, and the case where the valve opening degree is 0(%) corresponds to a fully closed state. That is, the CCV 710 is able to substantially freely control the circulation amount (that is, the feed rate) of coolant in the selected flow passage in addition to the function of selecting the coolant flow passage. Each of the above driving devices is electrically connected to the ECU 10Q, and the operation of the CCV 710 is substantially controlled by the ECU 100.

A mode similar to those of the first to third embodiments may be basically applied as the mode for selecting the operation mode of the cooling device according to the present embodiment. However, the configuration of the flow passage corresponding to the "second flow passage" according to the invention, differs from those of the above-described embodiments.

More specifically, the ECU 100 causes the flow passage CCVo4 and the flow passage CCVo5 to be closed through control over the opening degrees of the valves respectively arranged at the output ports at the time of selecting the operation mode M2 as the operation mode of the cooling device 700. That is, coolant is guided to only the flow passage CCVo3.

On the other hand, when coolant is guided to the flow passage CCVo3, the flow passage of coolant is automatically the flow passage CCVo3, the flow passage EGRo, the flow passage BP or flow passage RG, the flow passage WPi and the flow passage CCVi, and an example of the "second flow passage" according to the invention is achieved. In this case, the configuration of the "second flow passage" according to the invention for bypassing the radiator 530 is achieved by the thermostat 540. However, as described above, a set temperature at which the thermostat 540 guides coolant to the flow passage RG is a temperature equivalent to the warm-up temperature (the temperature value e according to the above-described embodiments) of the engine 200, and coolant bypasses the radiator 530 without any problem in the temperature region in which the operation mode M2 is selected.

According to the present embodiment, it is possible to form the flow passage for cooling the cylinder head 201B and the flow passage for cooling the cylinder block 201A independently of each other by the operation of the CCV 710. Thus, in a state where the operation mode M2 is selected, it is possible to sufficiently facilitate a warm-up of the cylinder block 201A while effectively drawing heat from the cylinder head 201B that is more strict in temperature condition than the cylinder block 201A and then feeding the heat to the EGR cooler 310. That is, in comparison with the configuration of the cooling device 500 according to the first to third embodiments, the warm-up effect of the EGR cooler 310 and the warm-up effect of the engine 200 both can be further improved.

In the present embodiment, the other auxiliaries 600 are provided. These other auxiliaries 600, different from the engine 200, do not always need to be early warmed up. In a configuration in which the cooling device includes a mechanical water pump (hereinafter, referred to as "mechanical W/P" where appropriate) that is driven by the engine torque of the engine 200 instead of the electric W/P 520 as the coolant circulation device, practically advantageous control that utilizes this point can be achieved.

For example, when the mechanical W/P is provided, in the temperature region in which the coolant temperature Tcl is lower than the temperature value a, only the flow passage CCVo5 may be selected through valve control over the CCV 710, and coolant may be circulated to only the other auxiliaries 60Q. The mechanical W/P operates on the basis of the output torque of the engine 200 in an operation period of the engine 200, so the driving load increases contrarily in a state where all the coolant flow passages are closed (for example, in a state corresponding to the operation mode M1).

In this case, by utilizing the other auxiliaries 600 irrespective of an engine warm-up at starting as so to speak a coolant relief flow passage, it is possible to reduce the driving load of the mechanical W/P. Such an operation of reducing the driving load in the mechanical W/P is remarkably effective to a reduction in the fuel consumption of the engine 200.

Fifth Embodiment

Next, a fifth embodiment of the invention will be described. In the fifth embodiment, the fact that the physical configuration of the cooling device that can prevent production of condensed water near the EGR cooler 310 at starting the engine 200 is not limited to the configurations illustrated in the first to fourth embodiments becomes apparent.

Figure 7:
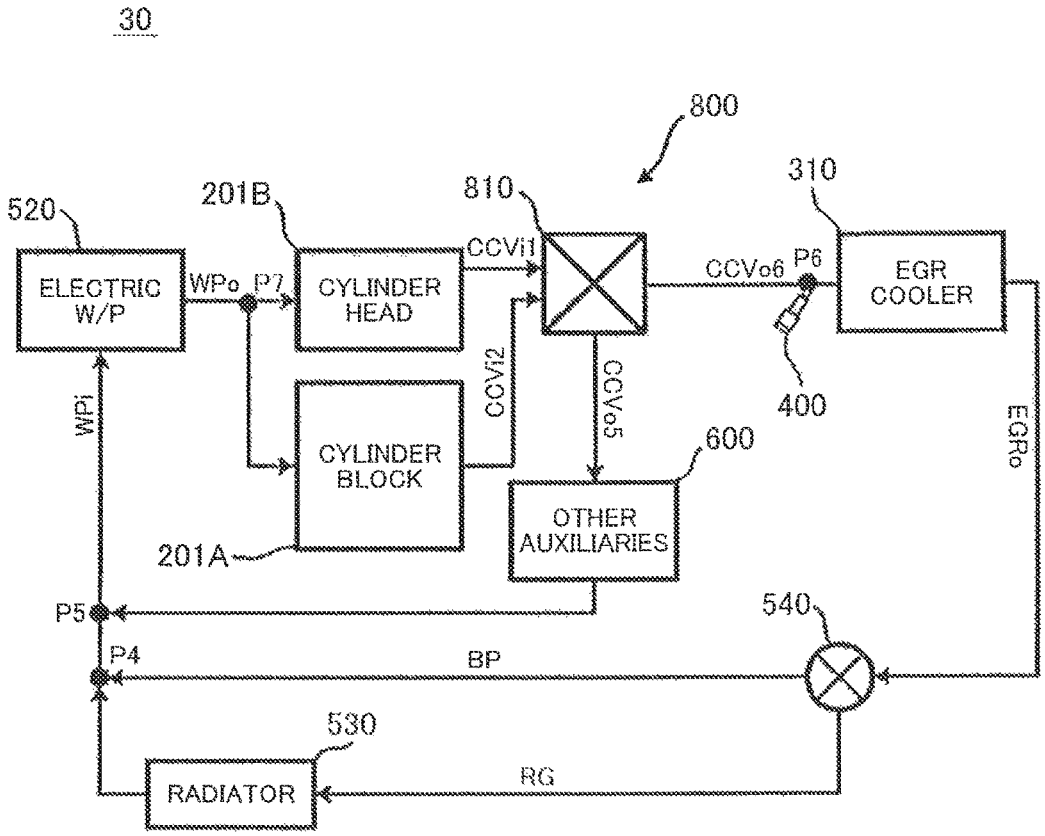
FIG. 7 is a block diagram of an engine system according to a fifth embodiment of the invention.

An engine system 30 according to the fifth embodiment of the invention will be described with reference to FIG. 7. FIG. 7 is a block diagram of the engine system 30. In the drawing, like reference numerals are assigned to portions that overlap with those in FIG. 1, and the description and drawing thereof are omitted where appropriate. The engine system 30 mainly differs from the engine system 20 in that a cooling device 800 is provided instead of the cooling device 700. The cooling device 800 differs from the cooling device 700 in that a CCV 810 is provided instead of the CCV 710. The cooling device 700 is changed to the cooling device 800, so the flow passage configuration is also changed.

More specifically, the cooling device 800 includes flow passages CCVi1, CCVi2, CCVo5, CCVo6 EGRo, RG, BP, WPi and WPo.

The flow passage CCVi1 is a coolant flow passage connected to a first input port of the CCV 810 and including a water jacket (not shown) that passes through the cylinder head 201B, and is another example of the "engine cooling flow passage" according to the invention.

The flow passage CCVi2 is a coolant flow passage connected ma second input port of the CCV 810 and including a water jacket (not shown) that passes through the cylinder block 201A, and is another example of the "engine cooling flow passage" according to the invention. The flow passage CCVi2 is connected to the flow passage CCVi1 (the water jacket of the cylinder head 201B in the drawing) at a portion downstream of the cylinder block 201A.

The flow passage CCVo5 is a coolant flow passage connected to a second output port of the CCV 810 and connected to the other auxiliaries 600, and is an example of the "auxiliary cooling flow passage" according to the invention.

The flow passage CCVo6 is a coolant flow passage connected to a first output port of the CCV 810. The flow passage CCCVo6 is connected to the flow passage EGRo at a connection point P6 at a portion upstream of the EGR cooler 310. The flow passage CCVo6 together with the flow passage EGRo constitutes another example of the "EGR cooling flow passage" according to the invention. The coolant temperature sensor 400 is configured to detect the coolant temperature Tcl at the connection point P6.

On the other hand, the flow passage WPo is connected to the output port of the electric W/P 520, and is branched into the flow passage CCVi1 and the flow passage CCVi2 at a connection point P7.

A large difference of the cooling device 800 from the cooling device 700 is that the CCV 810 that is an example of the "adjusting means" according to the invention is located at a portion downstream of the engine 200 in the coolant circulation passage.

In the CCV 810, the two input ports that are coolant input-side interfaces are respectively connected to the above-described flow passages CCVi1 and CCVi2, and, of the output ports that are two output-side interfaces, the first output port is connected to the flow passage CCVo6 and the second output port is connected to the flow passage CCVo5.

The CCV 810 is able to distribute coolant, which is input via one of the input ports, to the output ports. More specifically, the CCV 810 includes known solenoids, driving devices and valves. Each of the solenoids generates electromagnetic force by exciting current. Each of the driving devices supplies the exciting current. Each of the valves is arranged at a corresponding one of the output ports, and its valve opening degree continuously varies with the electromagnetic force. The opening degrees of the valves are allowed to be varied independently of each other.

Each valve opening degree is directly proportional to the flow passage area of a corresponding one of the output ports. The case where the valve opening degree is 100(%) corresponds to a fully open state, and the case where the valve opening degree is 0(%) corresponds to a fully closed state. That is, the CCV 810 is able to substantially freely control the circulation amount (that is, the feed rate) of coolant in the selected flow passage in addition to the function of selecting the coolant flow passage. Each of the above driving devices is electrically connected to the ECU 100, and the operation of the CCV 810 is substantially controlled by the ECU 100.

A mode similar to those of the first to third embodiments may be basically applied as the mode for selecting the operation mode of the cooling device according to the present embodiment. However, the configuration of the flow passage corresponding to the "second flow passage" according to the invention differs from those of the above-described embodiments.

More specifically, the ECU 100 causes the flow passage CCVi2 and the flow passage CCVo5 to be closed through control over the opening degrees of the valves respectively arranged at the output ports at the time of selecting the operation mode M2 as the operation mode of the cooling device 800. That is, coolant is input from the flow passage CCVi1 and is guided to the flow passage CCVo6.

On the other hand, when coolant is guided in this way, the coolant flow passage is the flow passage CCVo6 the flow passage EGRo, the flow passage BO or flow passage RCE, the flow passage WPi and the flow passage CCVi1, and an example of the "second flow passage" according to the invention is achieved. In this case, the configuration of the "second flow passage" according to the invention for bypassing the radiator 530 is achieved by the thermostat 540. However, as described above, a set temperature at which the thermostat 540 guides coolant to the flow passage RG is a temperature equivalent to the warm-up temperature (the temperature value e according to the above-described embodiments) of the engine 200, and coolant bypasses the radiator 530 without any problem in the temperature region in which the operation mode M2 is selected.

According to the present embodiment, as in the case of the fourth embodiment, it is possible to form the flow passage for cooling the cylinder head 201B and the flow passage for cooling the cylinder block 201A independently of each other by the operation of the CCV 810. Thus, in a state where the operation mode M2 is selected, it is possible to sufficiently facilitate a warm-up of the cylinder block 201A while effectively drawing heat from the cylinder head 201B that is more strict in temperature condition than the cylinder block 201A and then feeding the heat to the EGR cooler 310. That is, in comparison with the configuration of the cooling device 500 according to the first to third embodiments, the warm-up effect of the EGR cooler 310 and the warm-up effect of the engine 200 both can be further improved.

In this way, the CCV that serves as the "adjusting means" according to the invention may be located at a portion upstream of the engine 200 or a portion downstream of the engine 200, and a selection of the flow passage may be achieved by arranging the valve on the input port side or may be achieved by arranging the valve on the output port side.

In the first to fifth embodiments, the detected value of the coolant temperature Tcl by the coolant temperature sensor 400 is consistently utilized; however, there is a concern about particularly a biased coolant temperature in the embodiments in which coolant is not circulated at engine starting.

In terms of this point, the coolant temperature Tcl may be estimated on the basis of the operating condition of the engine 200 instead of or in addition to actual measurement of the sensor. At the time of estimating the coolant temperature, for example, an estimated result of the amount of heat generated based on the fuel injection amount of the engine 200 and an estimated result of the amount of heat released from various portions of the engine may be read. Various known methods are, of course, applicable as such a method of estimating the coolant temperature.

In the configuration in which the detected result of the coolant temperature Tcl by the coolant temperature sensor 400 is utilized, contrarily, after the timing of engine starting, circulation of a small amount of coolant may be allowed and the coolant temperature Tcl may be uniformed within the range of the concept of the operation of the limiting means for "limiting circulation of coolant" according to the invention.

In the first to fifth embodiments, coolant is consistently circulated and supplied by the electric W/P 520; instead, circulation and supply of coolant may be achieved by the mechanical W/P instead of the electric W/P.

The invention is not limited to the above-described embodiments. The invention is allowed to be modified as needed within the scope of the invention that can be interpreted from the appended claims and the whole specification without departing from the idea of the invention. The technical scope of the invention also encompasses a control device for a cooling system with such modifications.

INDUSTRIAL APPLICABILITY

The invention is applicable to a cooling device in a system including an engine and an EGR device.

DESCRIPTION OF REFERENCE NUMERALS

10 engine system, 20 engine system (fourth embodiment), 30 engine system (fifth embodiment), 100 ECU, 200 engine, 310 EGR cooler, 500 cooling device, 510 CCV, 520 electric W/P, 530 radiator, 600 other auxiliaries, 700 cooling device (fourth embodiment), 800 cooling device (fifth embodiment)

The invention claimed is:

1. A control device for a cooling system, which controls the cooling system in a vehicle including an internal combustion engine, an EGR device including an EGR cooler, and the cooling system that is able to cool cooled objects, including the internal combustion engine and the EGR device, through circulation of coolant, the cooling system including a flow passage portion that is able to pass the coolant and that includes an engine cooling flow passage for cooling the internal combustion engine, an EGR cooling flow passage for cooling the EGR device, a radiator flow passage that passes through a radiator and a bypass flow passage that bypasses the radiator; and a valve device being able to adjust a circulation amount of the coolant in a first flow passage including the engine cooling flow passage, the EGR cooling flow passage and the radiator flow passage and a second flow passage including the engine cooling flow passage, the EGR cooling flow passage and the bypass flow passage and not including the radiator flow passage, the control device comprising:

an electronic control unit configured to:

(i) measure a temperature of the coolant;

(ii) limit circulation of the coolant at starting the internal combustion engine;

(iii) circulate the coolant preferentially through the second flow passage via control over the valve device based on the measured temperature in a period in which circulation of the coolant is limited, (iv) prohibit circulation of the coolant before the coolant is circulated preferentially through the second flow passage, and (v) increase the circulation amount of the coolant in the second flow passage and then reduce the circulation amount after increasing the circulation amount in a period in which the coolant is circulated preferentially through the second flow passage.

2. The control device for the cooling system according to claim 1, wherein the electronic control unit is configured to circulate the coolant such that the temperature of the coolant in the EGR cooling flow passage does not become lower than or equal to an exhaust gas dew-point temperature.

3. The control device for the cooling system according to claim 1, wherein the electronic control unit is configured to circulate the coolant through each of the first and second flow passages before completion of a warm-up of the internal combustion engine in a period in which the coolant is circulated preferentially through the second flow passage.

4. The control device for the cooling system according to claim 1, wherein the electronic control unit is configured to control the circulation amount of the coolant in the second flow passage on the basis of a controlling element corresponding to an EGR amount of the EGR device in a period in which the coolant is circulated preferentially through the second flow passage.

5. The control device for the cooling system according to claim 1, wherein the cooled objects include an auxiliary other than the internal combustion engine or the EGR device, the flow passage portion includes an auxiliary cooling flow passage for cooling the auxiliary, the valve device includes a mechanical pump device that is driven by an engine torque of the internal combustion engine, and is further able to adjust the circulation amount of the coolant in a third flow passage including the auxiliary cooling flow passage and not including the engine cooling flow passage or the EGR cooling flow passage, and the electronic control unit is configured to circulate the coolant through the third flow passage in the period in which circulation of the coolant is limited.

6. The control device for the cooling system according to claim 1, wherein the electronic control unit is configured to circulate the coolant only through the second flow passage.

7. A control method for a cooling system, which controls the cooling system in a vehicle including an internal combustion engine, an electronic control unit, an EGR device including an EGR cooler, and the cooling system that is able to cool cooled objects, including the internal combustion engine and the EGR device, through circulation of coolant, the cooling system including a flow passage portion that is able to pass the coolant and that includes an engine cooling flow passage for cooling the internal combustion engine, an EGR cooling flow passage for cooling the EGR device, a radiator flow passage that passes through a radiator and a bypass flow passage that bypasses the radiator; and a valve device being able to adjust a circulation amount of the coolant in a first flow passage including the engine cooling flow passage, the EGR cooling flow passage and the radiator flow passage and a second flow passage including the engine cooling flow passage, the EGR cooling flow passage and the bypass flow passage and not including the radiator flow passage, the control method comprising:

measuring, by the electronic control unit, temperature of the coolant;

limiting, by the electronic control unit, circulation of the coolant at starting the internal combustion engine;

circulating, by the electronic control unit, the coolant preferentially through the second flow passage via control over the valve device based on the measured temperature in a period in which circulation of the coolant is limited; and prohibiting circulation of the coolant before the coolant is circulated preferentially through the second flow passage by the electronic control unit.

* * * * *